US009868310B2

(12) United States Patent
Oguchi et al.

(10) Patent No.: US 9,868,310 B2
(45) Date of Patent: Jan. 16, 2018

(54) PRINTER

(71) Applicant: FUJITSU COMPONENT LIMITED, Tokyo (JP)

(72) Inventors: Tatsuya Oguchi, Tokyo (JP); Sumio Watanabe, Tokyo (JP); Yukihiro Mori, Tokyo (JP); Masahiro Tsuchiya, Tokyo (JP); Yuji Yada, Tokyo (JP); Tetsuhiro Ishikawa, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/332,005

(22) Filed: Oct. 24, 2016

(65) Prior Publication Data

US 2017/0120644 A1 May 4, 2017

(30) Foreign Application Priority Data

Oct. 30, 2015 (JP) ..... 2015-215073

(51) Int. Cl.

| | |
|---|---|
| ***B41J 29/02*** | (2006.01) |
| ***B41J 2/335*** | (2006.01) |
| ***B41J 11/04*** | (2006.01) |
| ***B41J 2/32*** | (2006.01) |
| ***B41J 15/04*** | (2006.01) |

(52) U.S. Cl.

CPC ..... *B41J 29/02* (2013.01); *B41J 2/32* (2013.01); *B41J 2/335* (2013.01); *B41J 11/04* (2013.01); *B41J 15/042* (2013.01); *B41J 2202/31* (2013.01)

(58) Field of Classification Search

CPC ..... B41J 29/026; B41J 29/023; B41J 29/02; B41J 29/00; B41J 15/044; B41J 3/4075; B41J 32/00; B41J 2/32; B41J 15/042; B41J 11/0045; B41J 11/04; B41J 15/04; B41J 29/13

See application file for complete search history.

(56) References Cited

U.S. PATENT DOCUMENTS 5,820,068 A * 10/1998 Hosomi ..... B41J 29/02 242/563
6,744,457 B2 6/2004 Seino et al.
8,585,304 B2 11/2013 Yokoyama
(Continued)

FOREIGN PATENT DOCUMENTS

| | | |
|---|---|---|
| JP | H02-160558 | 6/1990 |
| JP | 2003-246104 | 9/2003 |
| JP | 2009-028910 | 2/2009 |

*Primary Examiner* — Kristal Feggins
(74) *Attorney, Agent, or Firm* — IPUSA, PLLC

(57) ABSTRACT

A printer includes a body, a lid pivotably attached to the body, a platen roller attached to the lid, and a lock lever. The body includes a print head and a holder to accommodate a roll of recording sheet. The lock lever supports a bearing of the platen roller when the lid is closed. The printer further includes a first plate and a second plate arranged on the lid in the widthwise direction of the printer, and a movable button provided on the lid. When the button is moved to slide the first and second plates toward each other, the outer end of each of the first and second plates in the widthwise direction moves inward to be positioned inside the outer frame of the holder to allow the closure of the lid.

5 Claims, 27 Drawing Sheets

(56) References Cited

U.S. PATENT DOCUMENTS

| | | | | |
|---|---|---|---|---|
| 2006/0007294 | A1* | 1/2006 | Sago | B41J 15/042 347/197 |
| 2009/0148217 | A1* | 6/2009 | Sanada | B41J 15/042 400/120.16 |

* cited by examiner

PRINTER

CROSS-REFERENCE TO RELATED APPLICATION

The present application is based upon and claims the benefit of priority of Japanese Patent Application No. 2015-215073, filed on Oct. 30, 2015, the entire contents of which are incorporated herein by reference.

BACKGROUND OF THE INVENTION

1. Field of the Invention

The present invention relates to printers.

2. Description of the Related Art

Printers are widely used for shop registers and automated teller machines (ATMs) or cash dispensers (CDs) in banks.

Such printers may include a printer body and a lid pivotably supported on the printer body. The lid is opened to allow a roll of recording sheet, such as recording paper, to be loaded into a paper holder of the printer body.

Reference may be made to, for example, Japanese Patent No. 2585769 and Japanese Laid-Open Patent Applications No. 2003-246104 and No. 2009-28910 for related art.

SUMMARY OF THE INVENTION

According to an aspect of the present invention, a printer includes a body, a lid pivotably attached to the body, a platen roller attached to the lid, and a lock lever. The body includes a print head and a holder to accommodate a roll of recording sheet. The lock lever supports a bearing of the platen roller when the lid is closed. The printer further includes a first plate and a second plate arranged on the lid in the widthwise direction of the printer, and a movable button provided on the lid. When the button is moved to slide the first and second plates toward each other, the outer end of each of the first and second plates in the widthwise direction moves inward to be positioned inside the outer frame of the holder to allow the closure of the lid.

DESCRIPTION OF THE EMBODIMENTS

Printers including a printer body and a lid may be used for information apparatus terminals such as ticket machines. When such ticket machines run out of recording paper, a user may be required to load recording paper. In this case, the user opens the lid to load the recording paper, and then closes the lid. When closing the lid, bearings of a platen roller enter locks provided one on each lateral side in the printer body. As a result, the lid is locked to make the printer ready to perform printing on the recording paper.

When the lid is externally pressed to be closed, however, one of the bearings may stop on the way to be only incompletely accommodated in one of the locks, although the other of the bearings is completely accommodated in the other of the locks. Such a state is referred to as a "half-lock" state, in which the platen roller is incorrectly positioned relative to a print head to prevent the printer from performing printing. In this half-lock state, the lid appears to be closed to a user, who may therefore think that printing is not performed in spite of the closure of the lid, thus determining that something is wrong with the printer. In order to eliminate the half-lock state, the lid may be pressed on the side on which the other of the lock parts is provided, or may be opened and closed again. Users, however, are reluctant to perform such an operation once determining that the printer is out of order. Therefore, the printer is prevented from performing printing, so that an information apparatus terminal in which the printer is installed becomes out of service.

According to a printer of an embodiment of the present invention, the half-lock state is less likely to occur to ensure the closure of a lid when closing the lid.

Embodiments of the present invention are described below with reference to the accompanying drawings.

First, the occurrence of a half-lock state at the time of closing the lid is described with reference to FIGS. 1 through 9.

Figure 1:
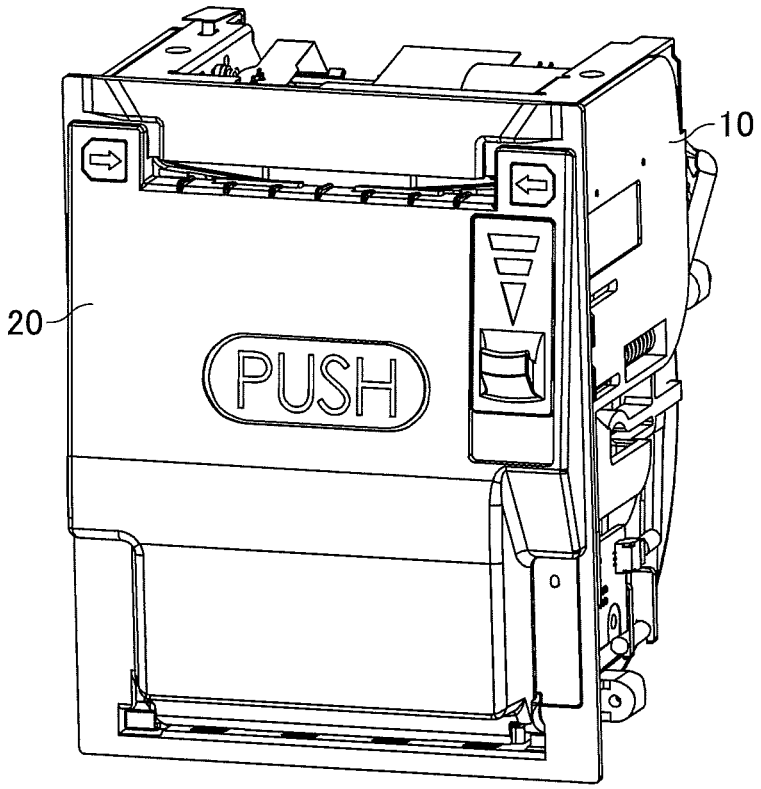
FIG. 1 is a perspective view of a printer whose lid is closed.
Figure 2:
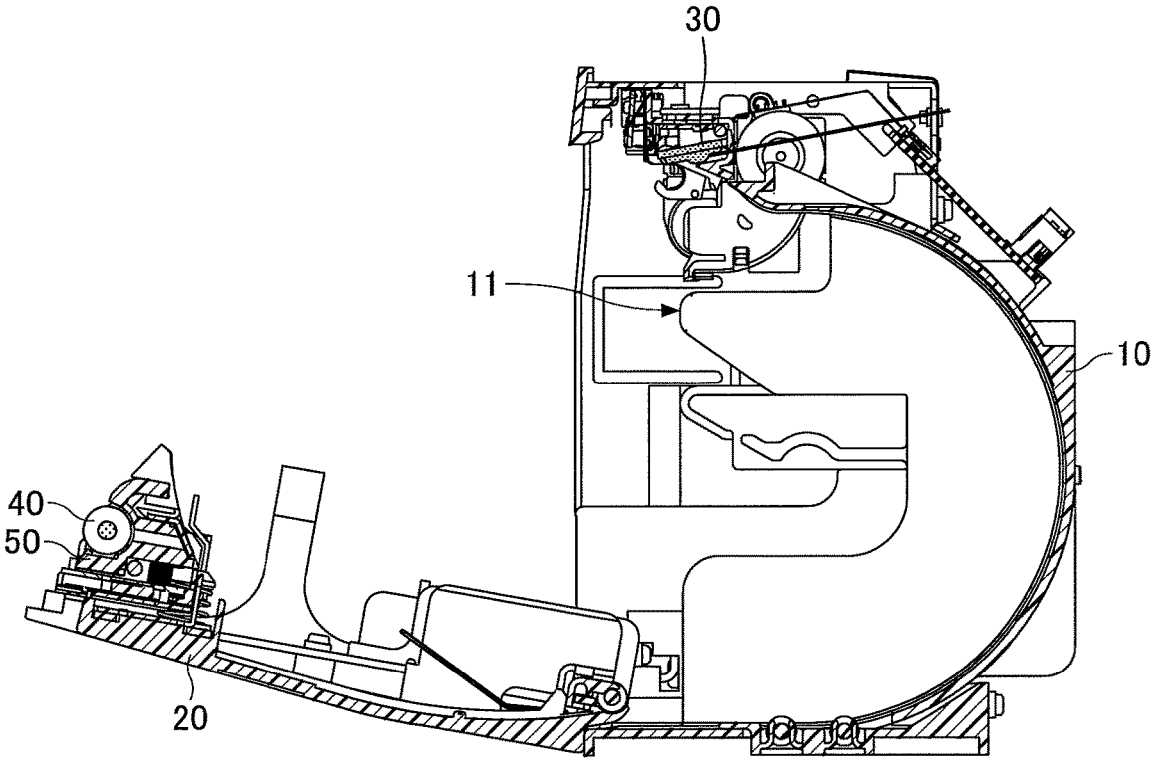
FIG. 2 is a cross-sectional view of the printer whose lid is open.
Figure 3:
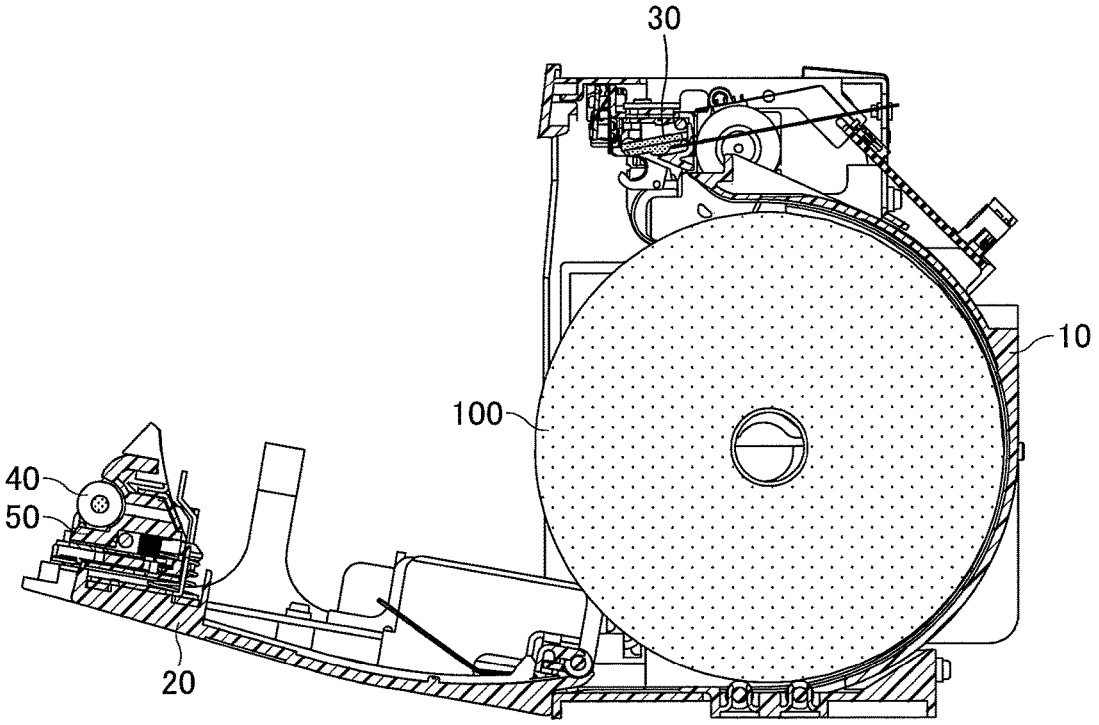
FIG. 3 is a cross-sectional view of the printer whose lid is open.

FIG. 1 is a perspective view of a printer whose lid is closed. FIGS. 2 and 3 are cross-sectional views of the printer whose lid is open before and after loading a roll of recording paper into the paper holder, respectively. The printer depicted in FIGS. 1 through 3 is a clamshell printer, in which the roll of recording paper is dropped and loaded into a paper holder.

Referring to FIGS. 1 through 3, the printer includes a body 10 and a lid 20 pivotally attached to the body 10. The body 10 includes a paper holder ("holder") 11 and a print head ("head") 30. The holder 11 accommodates the roll of recording paper 100 (hereinafter referred to as "roll"). A platen roller 40 and a cutter unit 50 for cutting the recording paper 100 are attached to the lid 20. The recording paper 100 is set in the printer by placing the roll in the holder 11 and closing the lid 20.

Figure 4:
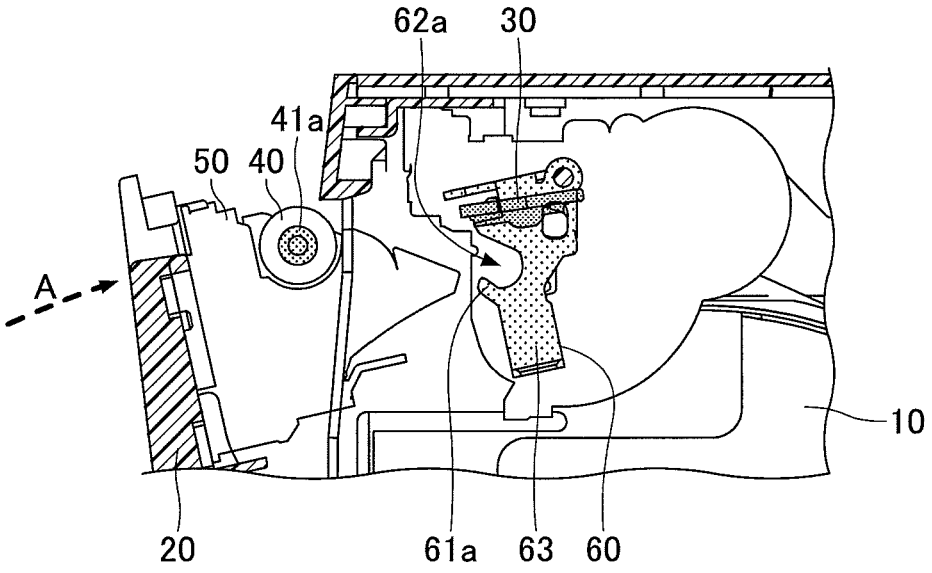
FIG. 4 is a diagram for explaining the closing of the lid of the printer.
Figure 5A:
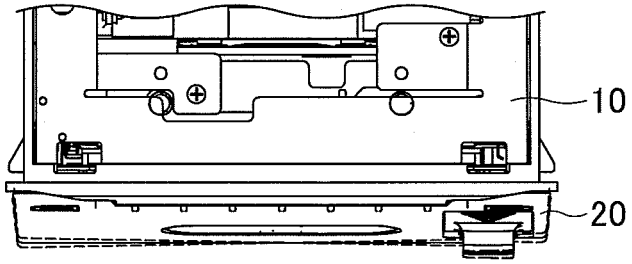
FIGS. 5A through 5C are diagrams for explaining the state of the printer where the lid is completely closed.
Figure 5B:
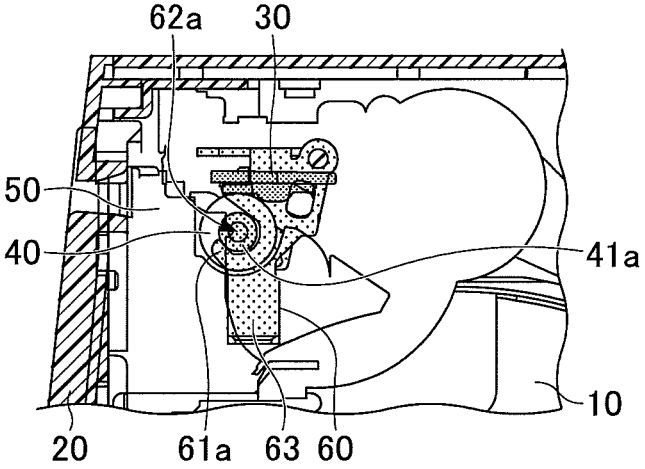
Figure 5C:
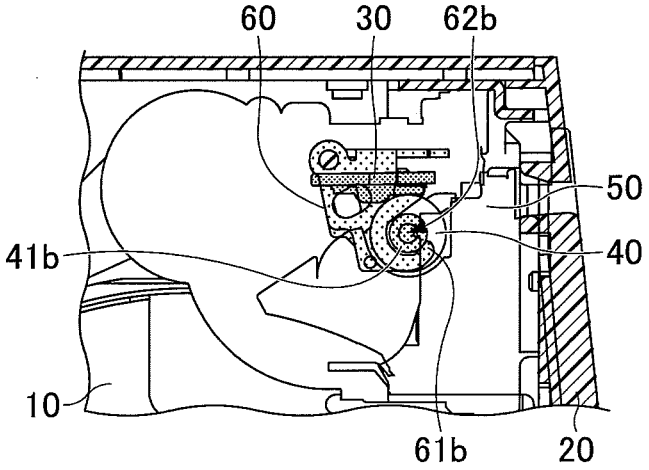

FIG. 4 is a cross-sectional view of part of the printer during the process of closing the lid 20 by pivoting the lid 20 in the direction indicated by the dashed arrow A. FIGS. 5A through 5C are diagrams for explaining the state of the printer whose lid 20 is completely closed. FIG. 5A is a plan view of the printer. FIGS. 5B and 5C are cross-sectional views of the printer of FIG. 5A, depicting a cross section near the right end and a cross section near the left end, respectively, of the printer of FIG. 5A. In FIG. 5A, the right-left direction corresponds to the widthwise direction of the printer.

Referring to FIGS. 4 through 5C, first and second bearings 41*a* and 41*b* are provided one at each axial end of the platen roller 40. A lock lever 60 configured to support and lock the first and second bearings 41*a* and 41*b* when the lid 20 is closed is provided in the body 10. The lever 60 includes a first lock 61*a* and a second lock 61*b* at opposite ends. An opening 62*a* that accommodates the first bearing 41*a* is formed in the first lock 61*a*. An opening 62*b* that accommodates the second bearing 41*b* is formed in the second lock 61*b*. The lever 60 includes an operation part 63 at the same end as the first lock 61*a*. The operation part 63 is operated to pivot the lever 60.

Accordingly, as depicted in FIGS. 5A through 5C, when the lid 20 is closed, the first bearing 41*a* is completely accommodated in the opening 62*a* and the second bearing 41*b* is completely accommodated in the opening 62*b* to completely lock the lid 20 to prevent the lid 20 from opening. Printing is performed on the recording paper 100 with the head 30 with the lid 20 being thus locked.

Figure 6:
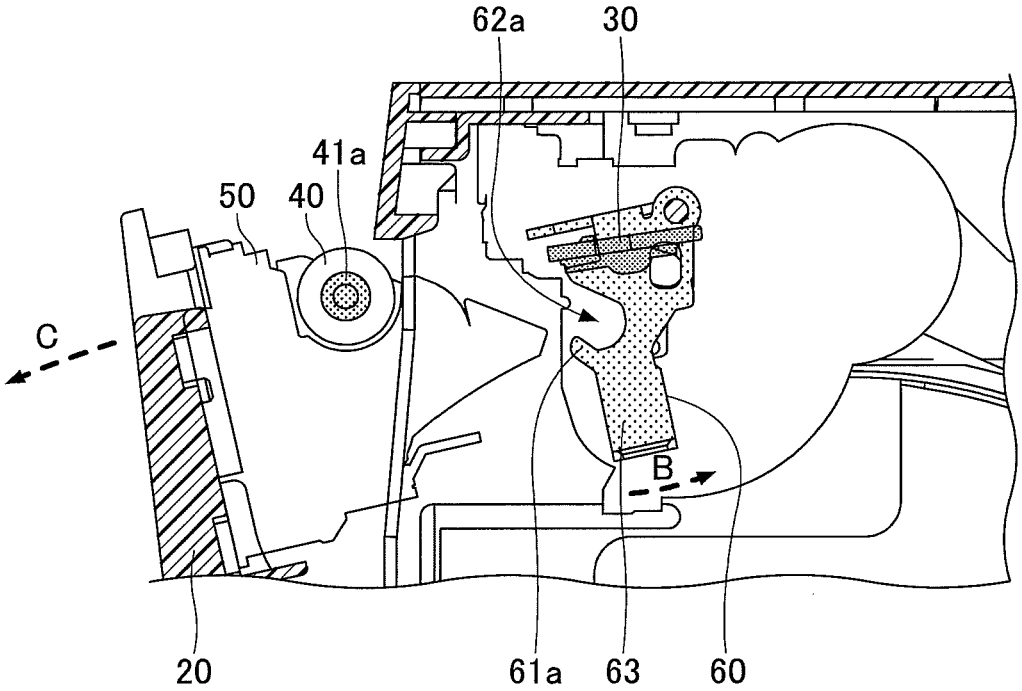
FIG. 6 is a diagram for explaining the opening of the lid of the printer.

When the lid 20 is opened, the operation part 63 is moved in the direction indicated by the dashed arrow B in FIG. 6. As a result, the first and second bearings 41*a* and 41*b* exit from the openings 62*a* and 62*b*, respectively, to pivot and open the lid 20 in the direction indicated by the dashed arrow C.

Figure 7A:
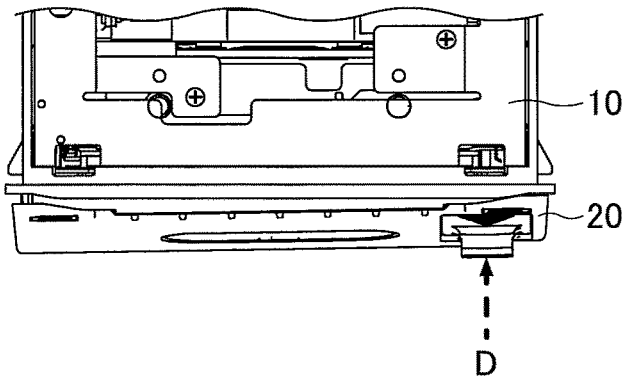
FIGS. 7A through 7C are diagrams for explaining the half-lock state of the lid of the printer.
Figure 7B:
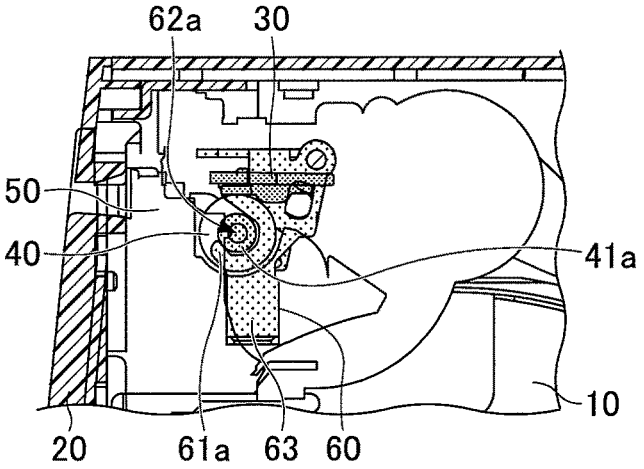
Figure 7C:
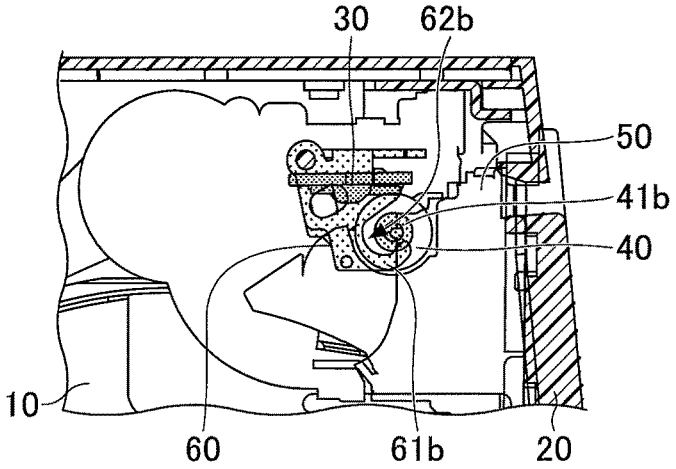
Figure 8A:
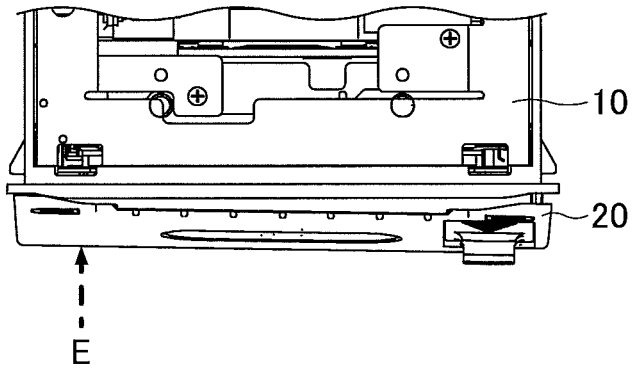
FIGS. 8A through 8C are diagrams for explaining the half-lock state of the lid of the printer.
Figure 8B:
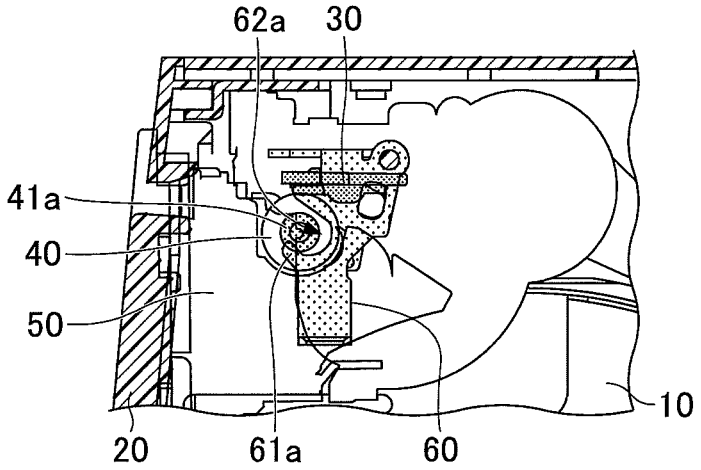
Figure 8C:
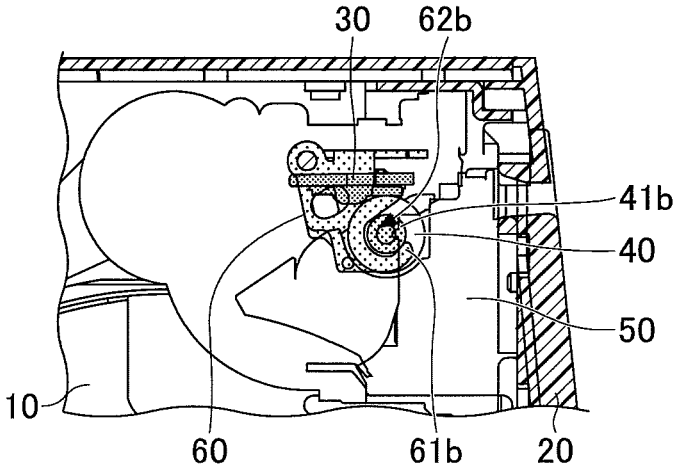
Figure 9:
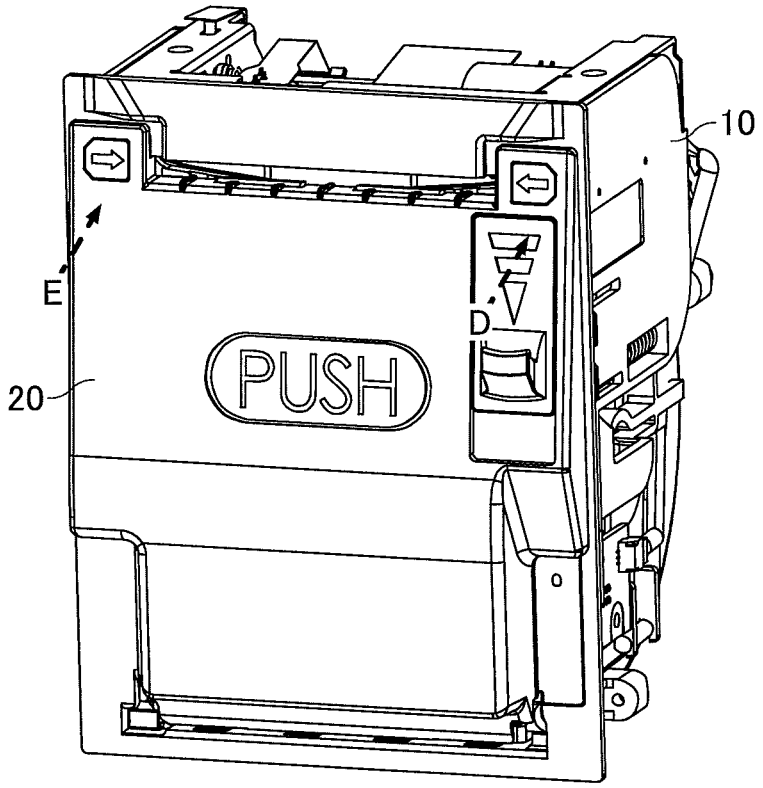
FIG. 9 is a diagram for explaining the occurrence of the half-lock state of the lid of the printer.

According to this printer, the half-lock state may occur when the second bearing 41*b* stops on the way to be only incompletely accommodated in the opening 62*b* while the first bearing 41*a* is completely accommodated in the opening 62*a* as depicted in FIGS. 7A through 7C (a first half-lock state) or when the first bearing 41*a* stops on the way to be only incompletely accommodated in the opening 62*a* while the second bearing 41*b* is completely accommodated in the opening 62*b* as depicted in FIGS. 8A through 8C (a second half-lock state). In these states, while one of the first and second bearings 41*a* and 41*b* is accommodated in one of the openings 62*a* and 62*b*, the other of the first and second bearings 41*a* and 41*b* is not completely accommodated in the other of the openings 62*a* and 62*b* to incorrectly position the platen roller 40 relative to the head 30 to prevent the printer from performing printing. FIG. 7A is a plan view of the printer in the first half-lock state. FIGS. 7B and 7C are cross-sectional views of the printer of FIG. 7A. FIG. 8A is a plan view of the printer in the second half-lock state. FIGS. 8B and 8C are cross-sectional views of the printer of FIG. 8A.

According to this printer, the first half-lock state depicted in FIGS. 7A through 7C may occur when the lid 20 is pressed only on the right side to be closed as indicated by the dashed arrow D. Furthermore, the second half-lock state depicted in FIGS. 8A through 8C may occur when the lid 20 is pressed only on the left side to be closed as indicated by the dashed arrow E.

[a] First Embodiment

Figure 10:
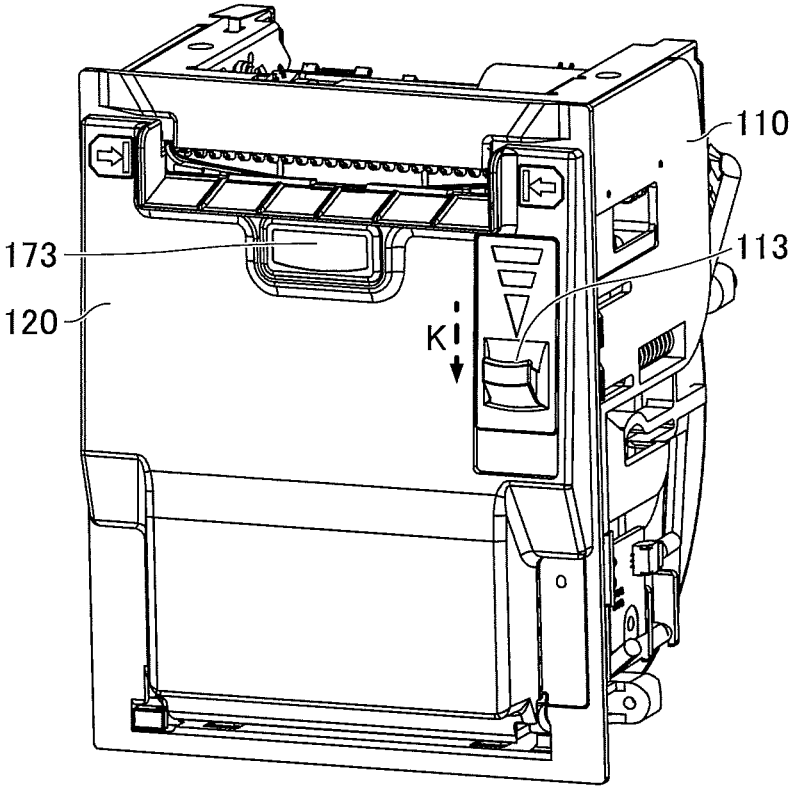
FIG. 10 is a perspective view of a printer whose lid is closed according to a first embodiment.
Figure 11:
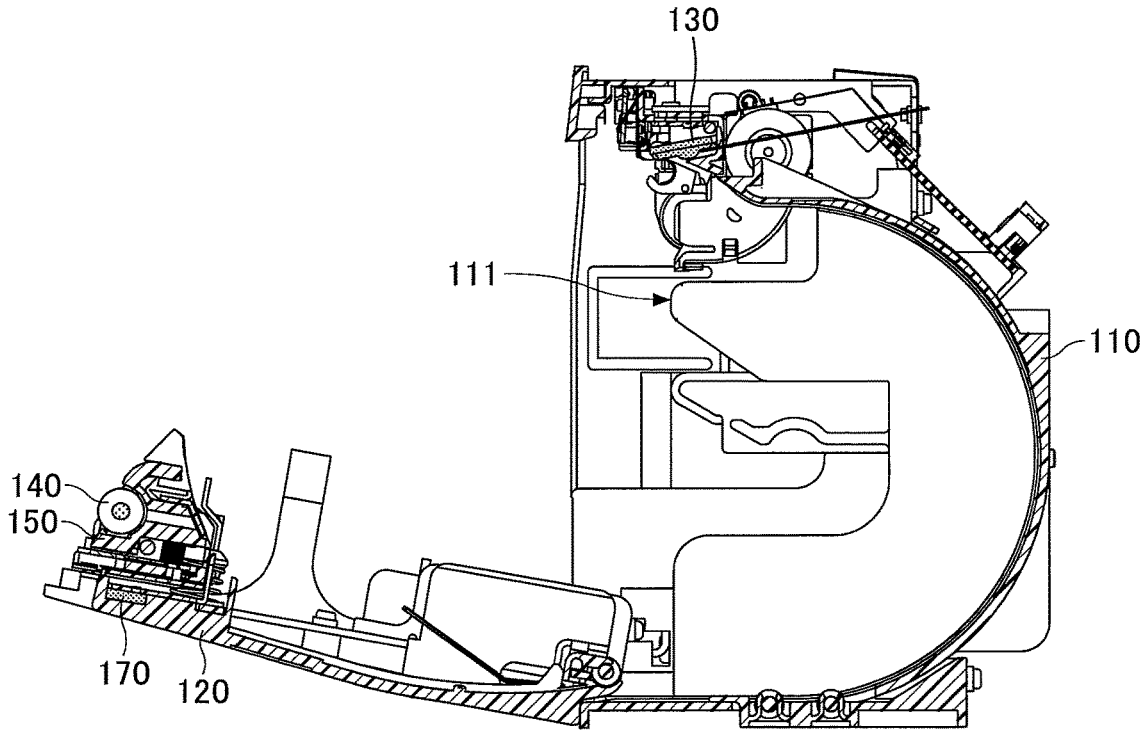
FIG. 11 is a cross-sectional view of the printer whose lid is open according to the first embodiment.
Figure 12:
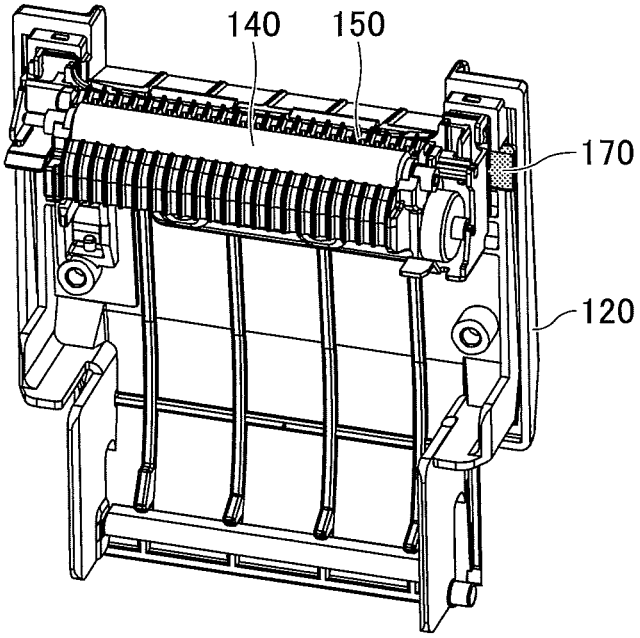
FIG. 12 is a perspective view of the lid of the printer according to the first embodiment.

Next, a printer according to a first embodiment is described with reference to FIGS. 10 through 19C. The printer of this embodiment is a clamshell printer. FIG. 10 is a perspective view of the printer whose lid is closed. FIG. 11 is a cross-sectional view of the printer whose lid is open. FIG. 12 is an inner-side perspective view of the lid.

Referring to FIGS. 10 through 12, the printer includes a body 110 and a lid 120 attached to the body 110 to be openable and closable relative to the body 110.

The body 110 includes a holder 111, a head 130 for printing on recording paper, a control circuit board, and motors. The head 130 is a thermal head. The holder 111 is shaped to accommodate a roll of recording paper, which is thermal paper according to this embodiment. The motors include a motor for driving a platen roller 140 to convey recording paper and a motor for driving a cutter unit 150 to cut recording paper.

Figure 13A:
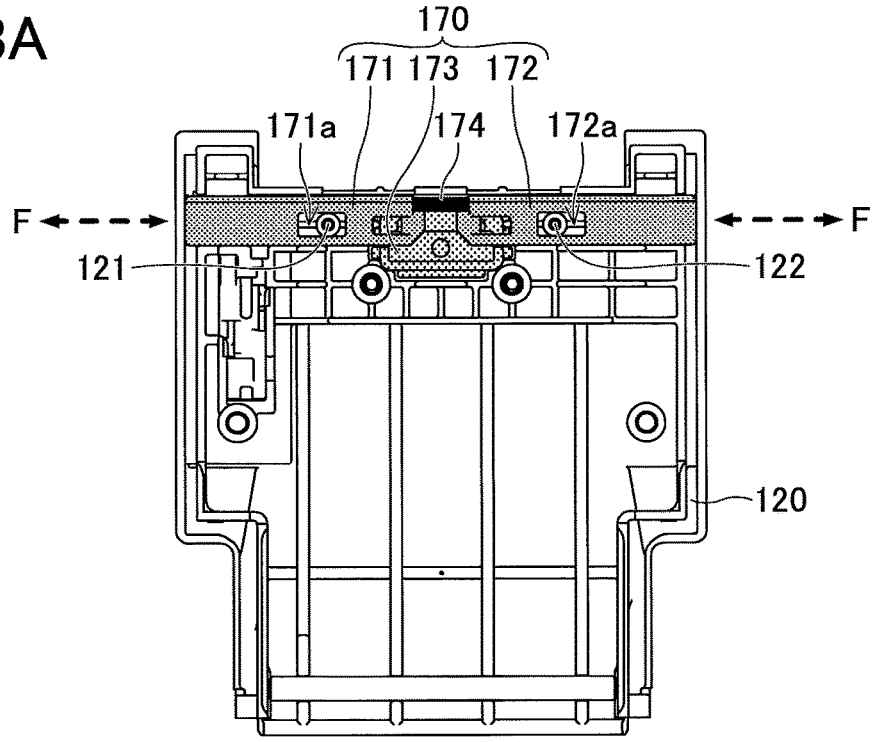
FIGS. 13A through 13C are diagrams depicting the lid of the printer according to the first embodiment.
Figure 13B:
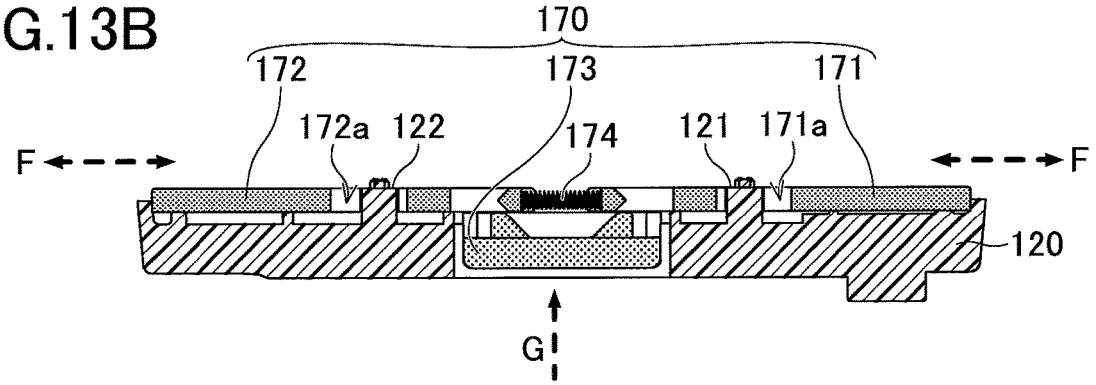
Figure 13C:
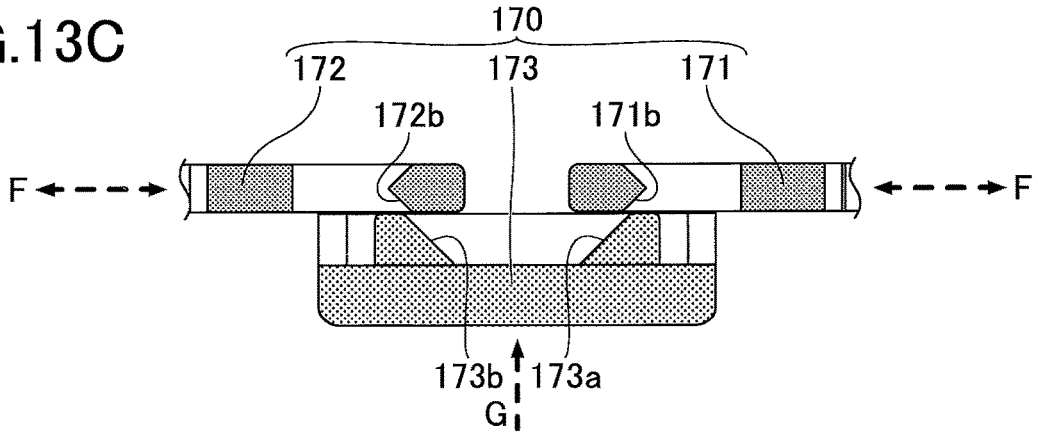

The platen roller 140, the cutter unit 150, and a slide mechanism 170 are provided on the lid 120. FIG. 13A is a diagram depicting the inside of the lid 120 from which the platen roller 140 and the cutter unit 150 are removed. FIG. 13B is a cross-sectional view of the printer of FIG. 13A. FIG. 13C is an enlarged view of part of the structure depicted in FIG. 13B. Referring to FIGS. 13A through 13C, the slide mechanism 170 includes two slidable plates 171 and 172 provided on the inside of the lid 120 and a push button 173 that slides the plates 171 and 172 in the directions indicated by the dashed arrows F. The button 173 is positioned in the widthwise center of an upper part of the lid 120 to be exposed outside the lid 120. The button 173 is pressed as indicated by the dashed arrow G to be operated. A coil spring 174 is provided between the plates 171 and 172 to exert forces in the directions to move the plates 171 and 172 away from each other, that is, in the directions to increase the interval between the plates 171 and 172. The button 173 is not pressed in the state depicted in FIGS. 13A through 13C.

A guide groove 171*a* (opening) elongated in the sliding directions indicated by the dashed arrows F is formed in the plate 171. A guide projection 121 provided on the inside of the lid 120 is positioned in the groove 171*a*. Likewise, a guide groove 172*a* (opening) elongated in the sliding directions is formed in the plate 172. A guide projection 122 provided on the inside of the lid 120 is positioned in the groove 172*a*.

Slopes 173*a* and 173*b* are formed in the inner surface of the button 173. The gap between the slopes 173*a* and 173*b* gradually widens in the direction in which the button 173 is pressed, that is, toward the inside of the printer. The plate 171 includes a slope 171*b* corresponding in inclination to the slope 173*a*. The plate 172 includes a slope 172*b* corresponding in inclination to the slope 173*b*. For example, the slope 173*a* is parallel to the slope 171*b*, and the slope 173*b* is parallel to the slope 172*b*.

Figure 14A:
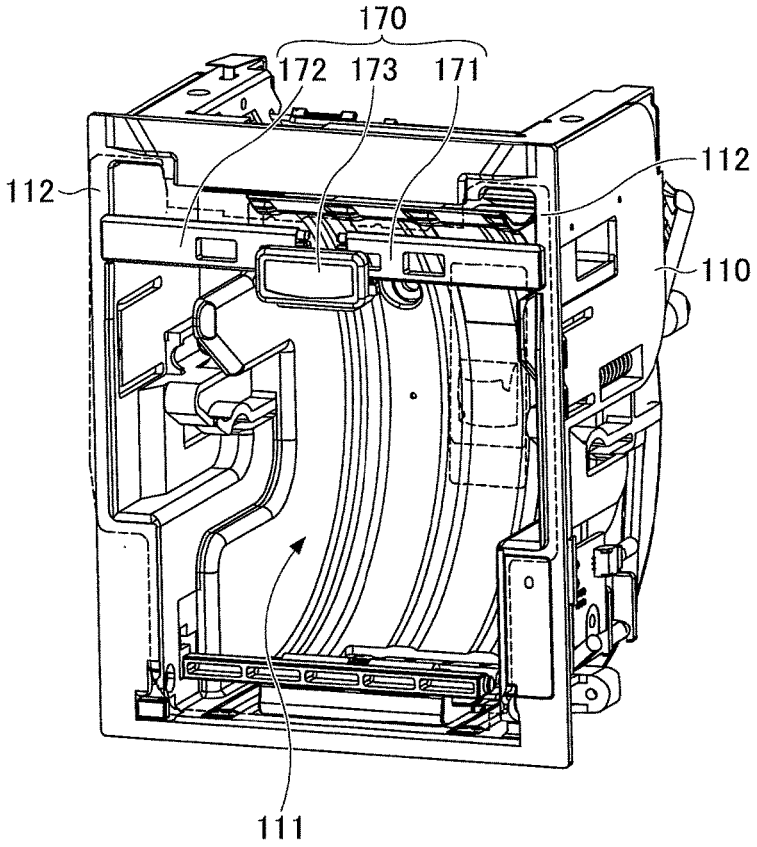
FIGS. 14A through 14C are diagrams for explaining how the lid of the printer is prevented from being closed according to the first embodiment.
Figure 14C:
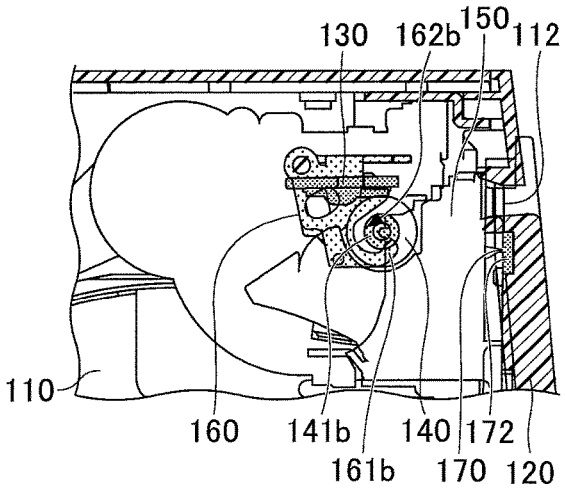
Figure 14B:
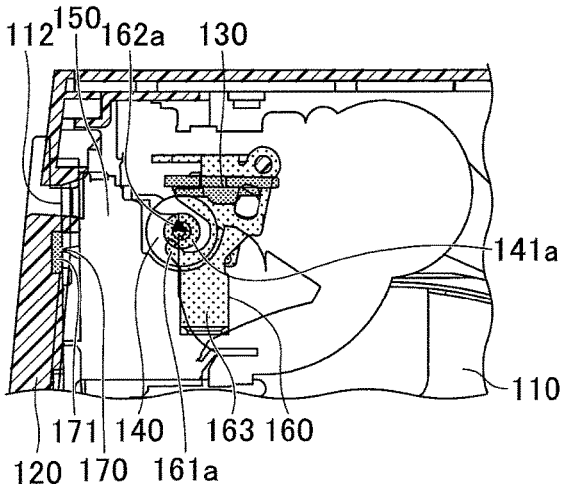

FIGS. 14A through 14C are diagrams for explaining how the lid 120 is prevented from being closed. FIG. 14A is a perspective view of the printer in the state where the lid 120 is prevented from being closed. In FIG. 14A, a depiction of some parts of the printer, such as the lid 120, is omitted for convenience of description. FIGS. 14B and 14C are cross-sectional views of the printer in this state, depicting a cross section near the right end and a cross section near the left end, respectively, of the printer of FIG. 14A. The widthwise direction of the printer is parallel to the axial direction of the platen roller 140.

Referring to FIGS. 14B and 14C, first and second bearings 141*a* and 141*b* are provided one at each axial end of the platen roller 140. A lock lever 160 configured to support and lock the first and second bearings 141*a* and 141*b* when the lid 120 is closed is provided in the body 110. The lever 160 includes a first lock 161*a* and a second lock 161*b* at opposite ends. An opening 162*a* that accommodates the first bearing 141*a* is formed in the first lock 161*a*. An opening 162*b* that accommodates the second bearing 141*b* is formed in the second lock 161*b*. The lever 160 includes an operation part 163 at the same end as the first lock 161*a*. The operation part 163 is operated to pivot the lever 160.

According to the printer of this embodiment, even when the lid 120 is pressed in an effort to close the lid 120, the lid 120 cannot be closed because the plates 171 and 172 contact an outer frame 112 of the holder 111 on each side of the body 110 in the widthwise direction of the printer (that is, at the right end and the left end of the printer) as depicted in FIGS. 14A through 14C. In this state, the first bearing 141*a* is not accommodated in the opening 162*a*, and likewise, the second bearing 141*b* is not accommodated in the opening 162*b*. Therefore, the lid 120 is not closed and not locked.

Figure 15A:
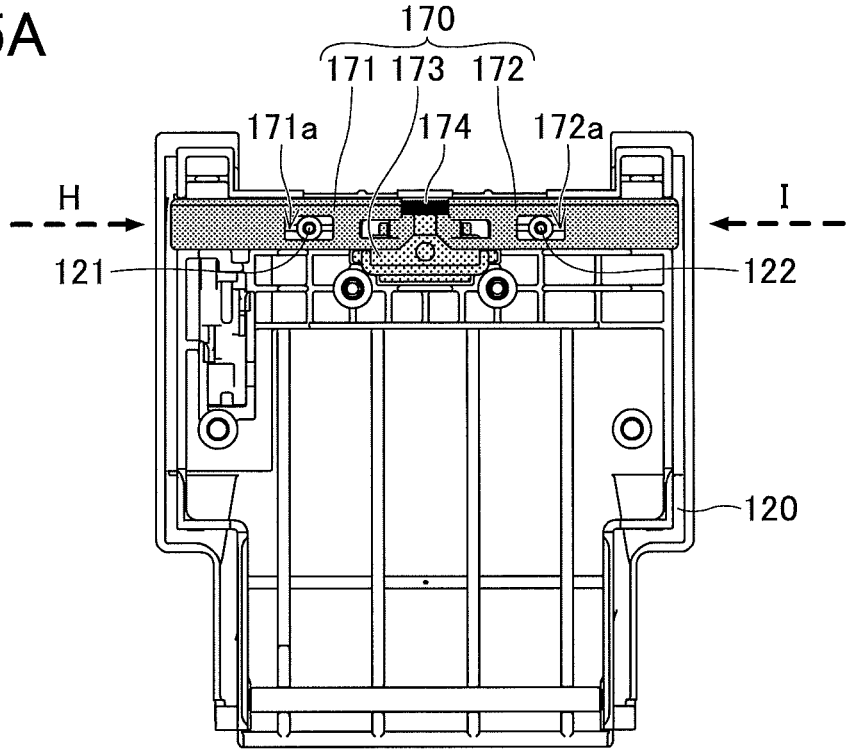
FIGS. 15A and 15B are diagrams for explaining the operation of closing the lid of the printer according to the first embodiment.
Figure 15B:
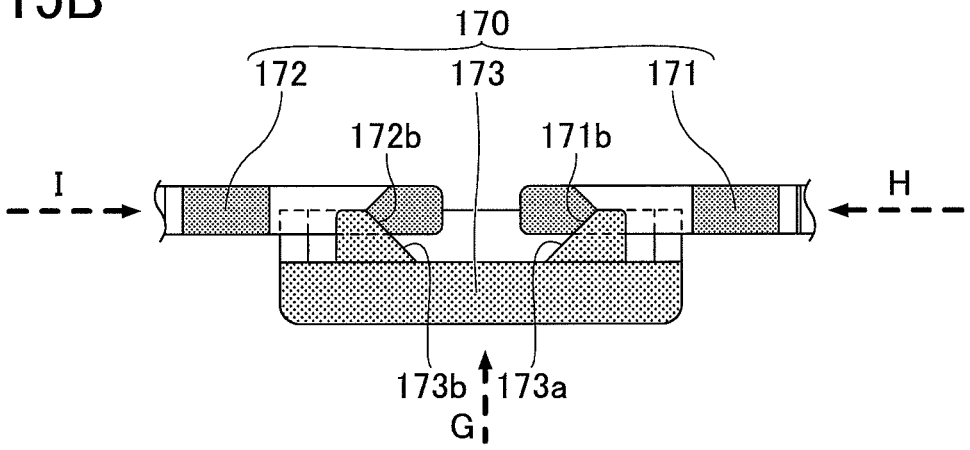
Figure 16A:
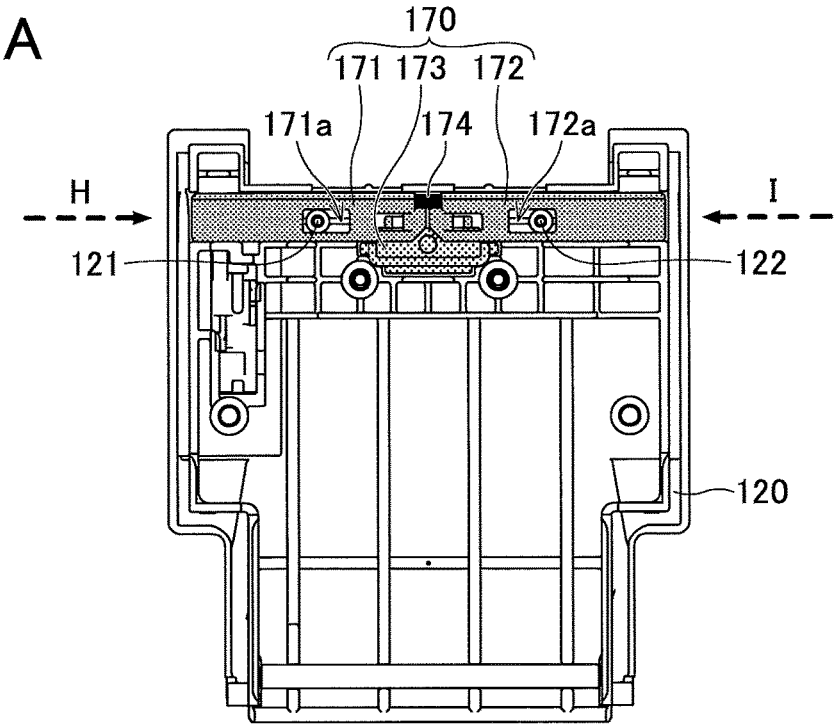
FIGS. 16A through 16C are diagrams for explaining the operation of closing the lid of the printer according to the first embodiment.
Figure 16B:
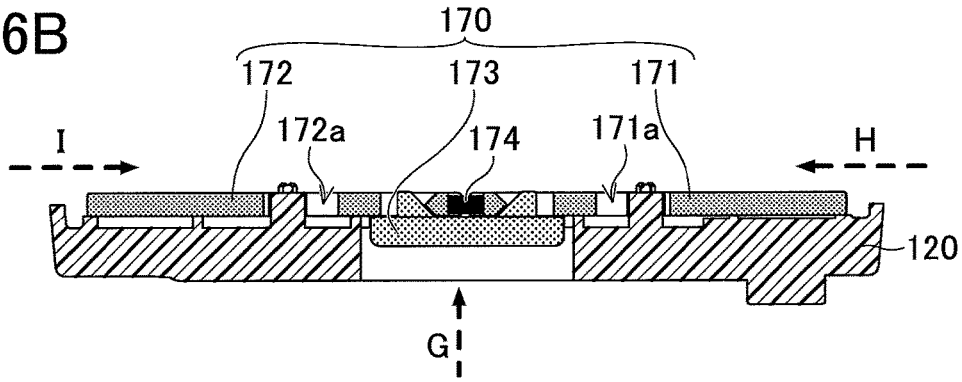
Figure 16C:
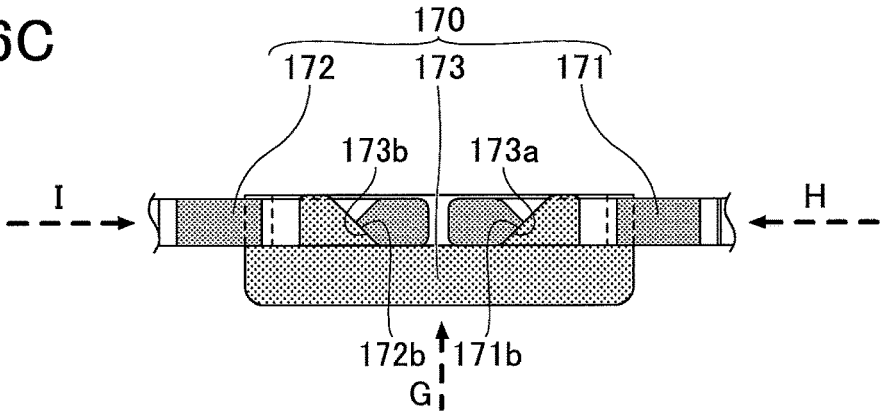

When closing the lid 120, the button 173 is pressed in the direction indicated by the dashed arrow G from the position depicted in FIGS. 13A through 13C. As a result, the plates 171 and 172 slide to be in the state as depicted in FIGS. 15A and 15B and then in the state as depicted in FIGS. 16A through 16C. FIG. 15A is a diagram depicting the inside of the lid 120 during the pressing of the button 173. FIG. 153 is an enlarged cross-sectional view of part of the lid 120 of FIG. 15A. FIG. 16A is a diagram depicting the inside of the lid 120 where the button 173 is completely pressed. FIG. 16B is a cross-sectional view of the lid 120. FIG. 16C is an enlarged view of part of FIG. 16B. In FIGS. 15A and 16A, the platen roller 140 and the cutter unit 150 are removed from the lid 120.

When the button 173 is pressed, the button 173 presses the slope 171*b* with the slope 173*a*. As a result, the slope 173*a* moves on the slope 171*b* to slide the plate 171 in the direction indicated by the dashed arrow H. At the same time, the button 173 presses the slope 172*b* with the slope 173*b*, and the slope 173*b* moves on the slope 172*b* to slide the plate 172 in the direction indicated by the dashed arrow I.

Figure 17A:
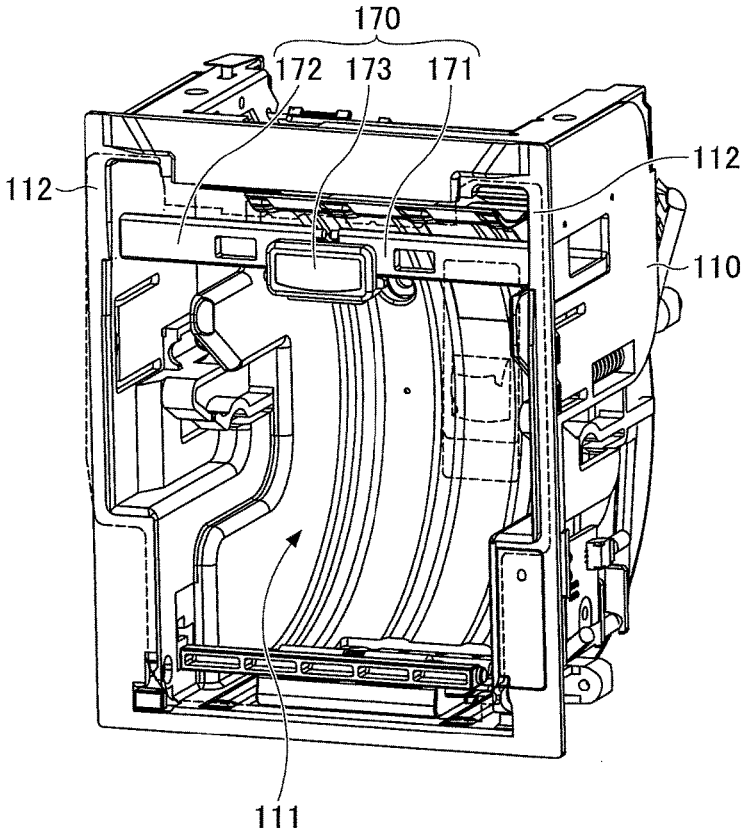
FIGS. 17A through 17C are diagrams for explaining how the lid of the printer is closed according to the first embodiment.
Figure 17C:
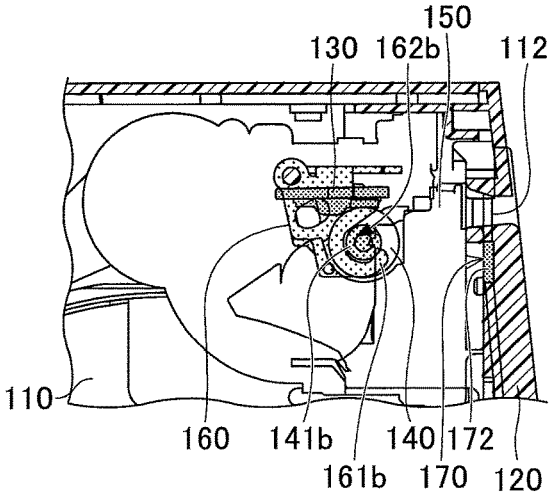
Figure 17B:
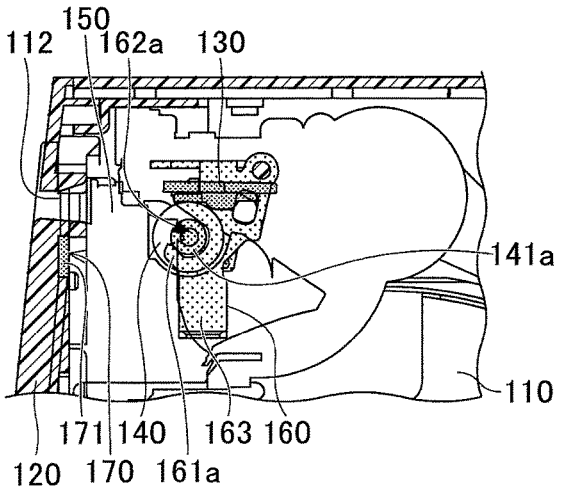

Referring to FIGS. 16A through 16C, the button 173 is pressed to slide the plates 171 and 172 toward each other. As a result, the plates 171 and 172 have their respective outer ends retract, that is, move inward to be positioned inside the frame 112. Therefore, the plates 171 and 172 are allowed to enter the inside of the holder 111 to allow the closure of the lid 120. Because the button 173 is positioned in the widthwise center of the lid 120, the first and second bearings 141*a* and 141*b* enter the opening 162*a* and the opening 162*b*, respectively. FIGS. 17A through 17C are diagrams depicting the state of the printer where the first and second bearings 141*a* and 141*b* are accommodated in the openings 162*a* and 162*b*, respectively. FIG. 17A is a perspective view of the printer in this state. In FIG. 17A, a depiction of some parts of the printer is omitted for convenience of description. FIGS. 17B and 17C are cross-sectional views of the printer in this state, depicting a cross section near the right end and a cross section near the left end, respectively, of the printer of FIG. 17A.

That is, according to this embodiment, the button 173 is positioned in the center of the lid 120, and the lid 120 is not closed unless the button 173 is pressed. Accordingly, no half-lock state occurs.

Figure 18A:
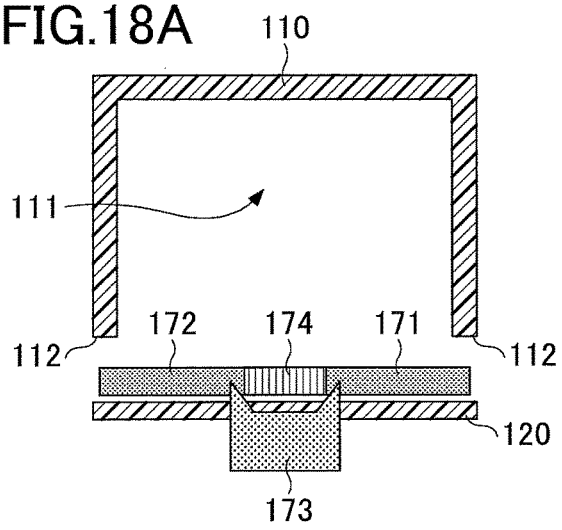
FIGS. 18A through 18E are diagrams for explaining the operation of closing the lid of the printer according to the first embodiment.
Figure 18D:
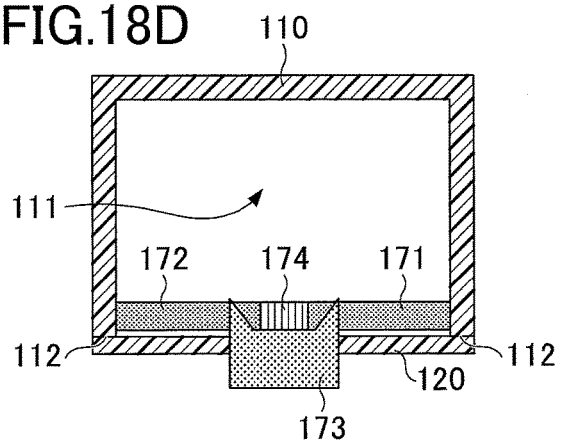
Figure 18B:
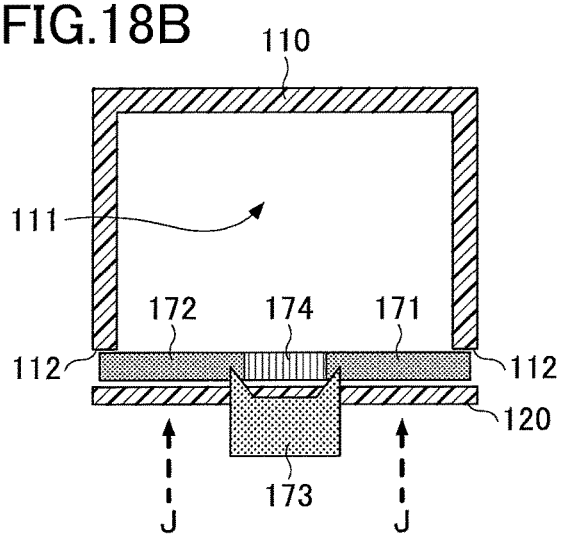
Figure 18E:
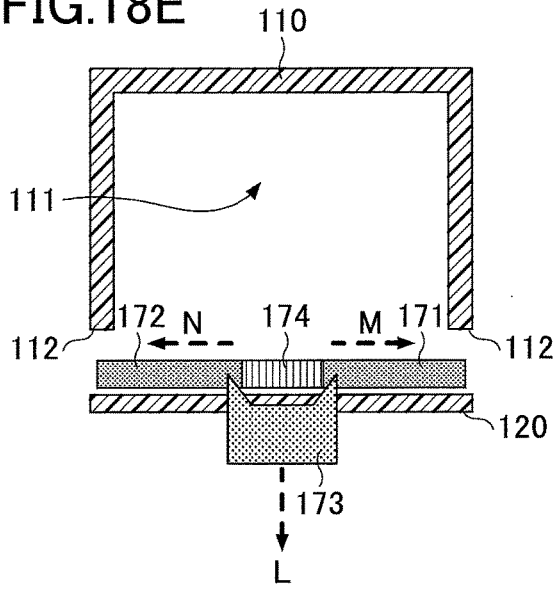
Figure 18C:
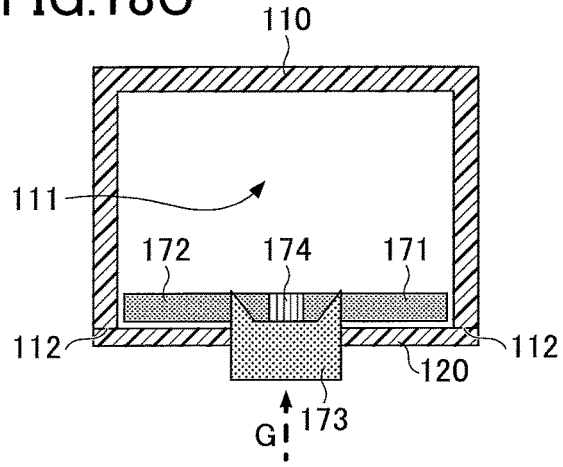

An overview of a process of closing the lid 120 of this embodiment is given with reference to FIGS. 18A through 18E. FIG. 18A depicts the printer whose lid 120 is open. In this state, the button 173 is not pressed, and the plates 171 and 172 remain urged outward. When an attempt to close the lid 120 is made in this state by pressing the lid 120 in the direction indicated by the dashed arrow J, the plates 171 and 172 that are urged outward contact the frame 112 to prevent the lid 120 from being closed as depicted in FIG. 18B. This state corresponds to the state as depicted in FIGS. 13A through 14C.

According to the printer of this embodiment, the button 173 is pressed in the direction indicated by the dashed arrow G when closing the lid 120. As a result, the plates 171 and 172 approach each other to narrow the gap between the plates 171 and 172, so that the plates 171 and 172 pass the frame 112 to enter the inside of the holder 111 to allow the closure of the lid 120. FIG. 18D depicts the printer whose lid 120 is closed. This state corresponds to the state as depicted in FIGS. 16A through 17C.

When opening the lid 120, an unlocking lever 113 provided on the lid 120 is pressed down in the direction indicated by the dashed arrow K to press the operation part 163. As a result, the lever 160 moves to cause the first and second bearings 141*a* and 141*b* to exit from the corresponding openings 162*a* and 162*b* to allow the lid 120 to open in the direction indicated by the dashed arrow L. At this point, the restoring force of the spring 174 project the plates 171 and 172 rightward and leftward, respectively. That is, the restoring force of the spring 174 slides the plate 171 in the direction indicated by the dashed arrow M and slides the plate 172 in the direction indicated by the dashed arrow N. As a result, the plates 171 and 172 laterally move away from each other to widen the gap between the plates 171 and 172.

When the lid 120 is closed, the restoring force of the spring 174 keeps the outer ends of the plates 171 and 172 in contact with right and left inner wall surfaces of the holder 111 as depicted in FIG. 18D. The plates 171 and 172, however, are not part of the mechanism to lock the lid 120.

Accordingly, the lid 120 is locked by the first and second bearings 141*a* and 141*b* entering the corresponding openings 162*a* and 162*b*.

According to the printer of this embodiment, the plates 171 and 172 may be formed of either a resin material such as mold resin or a metal material. In the case of forming the plates 171 and 172 using a metal material, the plates 171 and 172 may be formed of a processed sheet metal such as a processed stainless sheet or formed of a die casting such as a zinc die casting.

Figure 19A:
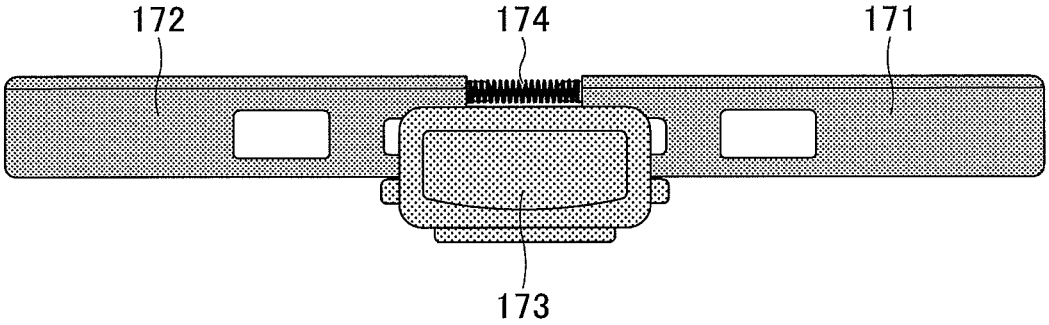
FIGS. 19A through 19C are diagrams illustrating a spring of a slide mechanism of the printer according to the first embodiment.
Figure 19B:
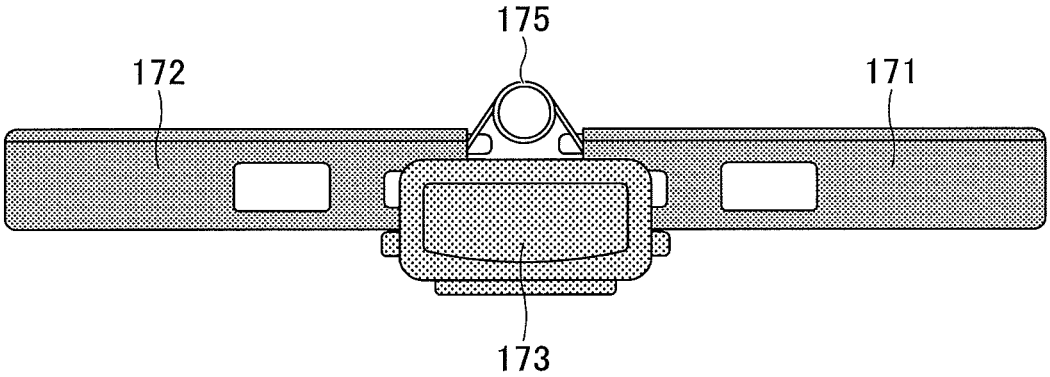
Figure 19C:
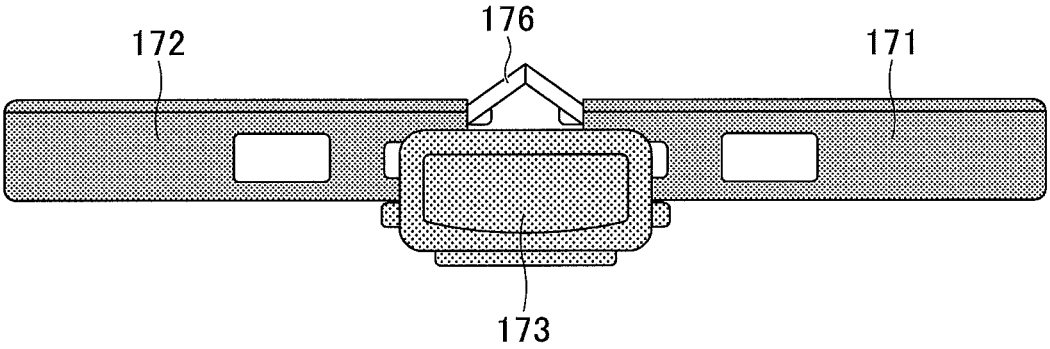

In the above-described case, the slide mechanism 170 employs the coil spring 174 as depicted in FIG. 19A. According to this embodiment, however, a torsion coil spring 175 may alternatively be employed in lieu of the spring 174 as depicted in FIG. 19B, or a leaf spring 176 may alternatively be employed as depicted in FIG. 19C.

[b] Second Embodiment

Figure 20:
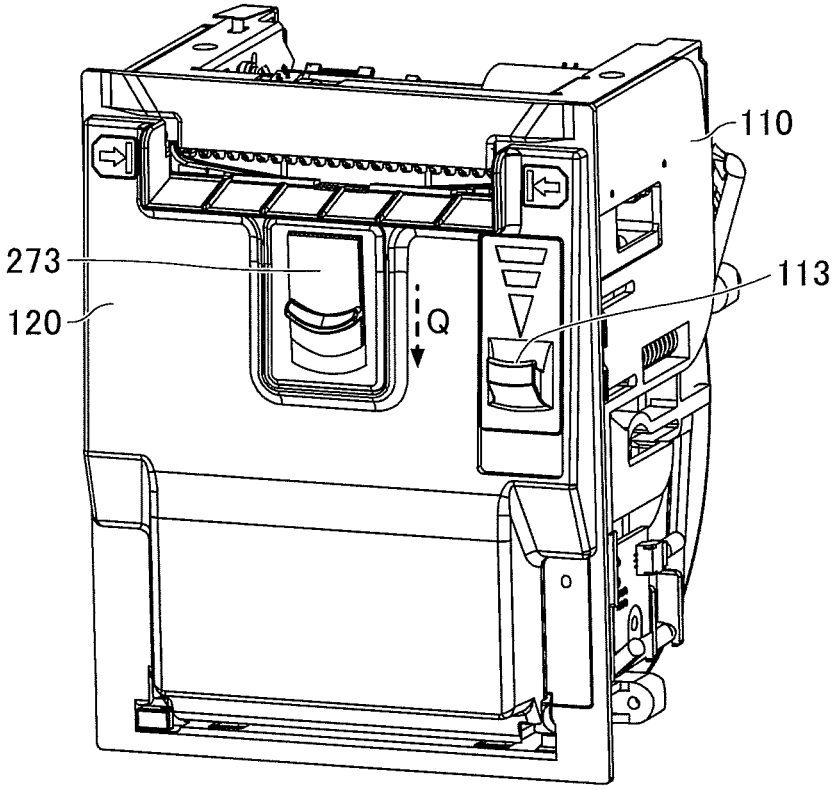
FIG. 20 is a perspective view of a printer whose lid is closed according to a second embodiment.
Figure 21:
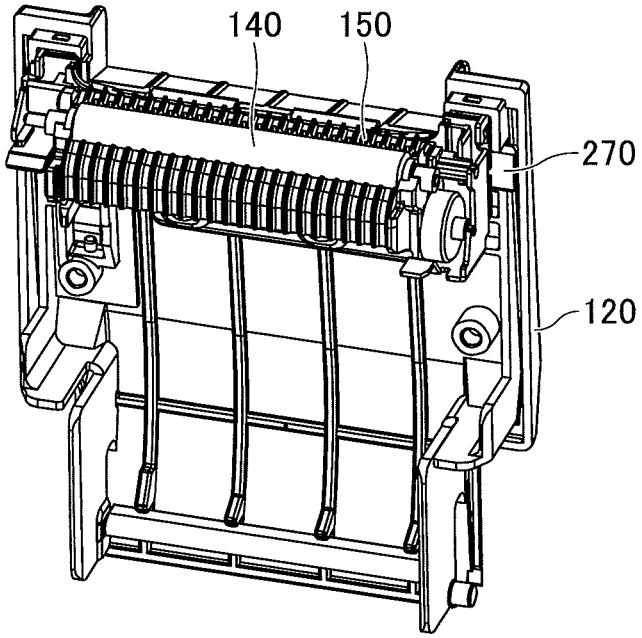
FIG. 21 is a perspective view of the lid of the printer according to the second embodiment.

A printer according to a second embodiment employs a slide mechanism that is different from the slide mechanism 170 of the first embodiment. The printer of this embodiment is described below with reference to FIGS. 20 through 28C. FIG. 20 is a perspective view of the printer whose lid is closed. FIG. 21 is an inner-side perspective view of the lid. In the following description, the same elements as those described above are referred to using the same reference numerals, and a description thereof may be omitted.

Referring to FIGS. 20 and 21, the printer includes the body 110 and the lid 120 attached to the body 110 to be pivotable about a shaft.

Figure 22:
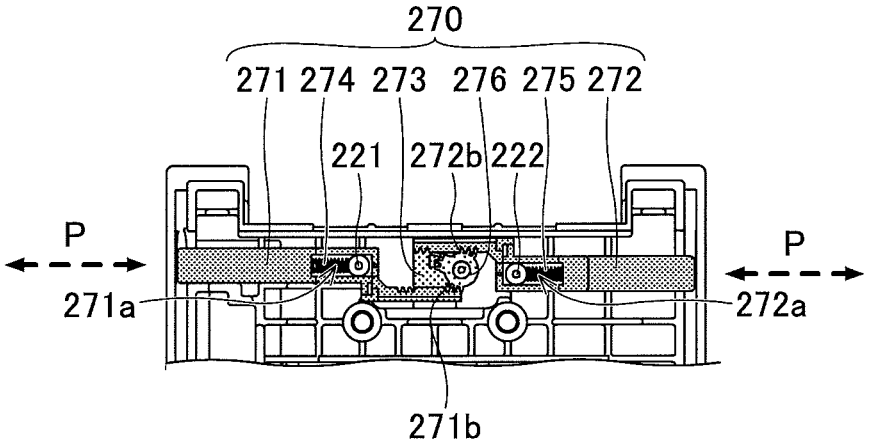
FIG. 22 is a diagram depicting the lid of the printer according to the second embodiment.

Besides the platen roller 140 and the cutter unit 150, a slide mechanism 270 is provided on the lid 120. FIG. 22 is a diagram depicting the inside of the lid 120 from which the platen roller 140 and the cutter unit 150 are removed. Referring to FIG. 22, the slide mechanism 270 includes two slidable plates 271 and 272 provided on the inside of the lid 120, a slide button 273 that slides the plates 271 and 272 in the directions indicated by the dashed arrows P, coil springs 274 and 275, and a connecting gear 276. The button 273 is positioned in the widthwise center of an upper part of the lid 120 to be exposed outside the lid 120 as depicted in FIG. 20. The button 273 is slid in the direction indicated by the dashed arrow Q along the outer surface of the lid 120 to be operated. FIG. 20 depicts the state of the printer before the button 273 is slid downward.

An opening 271*a* elongated in the directions indicated by the dashed arrows P is formed in the plate 271. A projection 221 provided on the lid 120 is positioned in the opening 271*a*. The spring 274 is installed between the projection 221 and a surface of the plate 271 exposed in the opening 271*a* and facing in the direction away from the outer end of the plate 271. Furthermore, an opening 272*a* elongated in the directions indicated by the dashed arrows P is formed in the plate 272. A projection 222 provided on the lid 120 is positioned in the opening 272*a*. The spring 275 is installed between the projection 222 and a surface of the plate 272 exposed in the opening 272*a* and facing in the direction away from the outer end of the plate 272. Each of the springs 274 and 275 exerts a restoring force in a direction to stretch.

Figure 23:
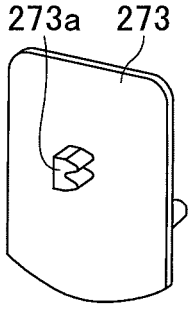
FIG. 23 is a diagram depicting a slide button of the lid of the printer according to the second embodiment.
Figure 28A:
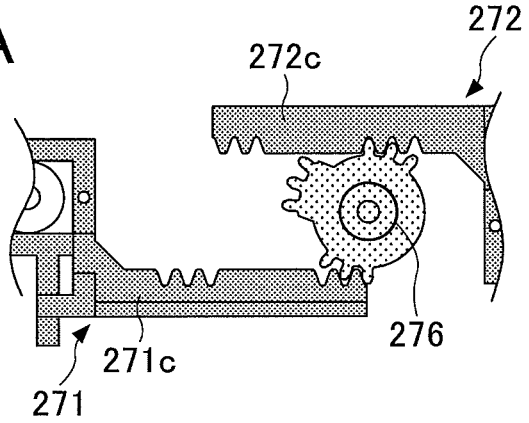
FIGS. 28A through 28C are diagrams for explaining the operation of closing the lid of the printer according to the second embodiment.
Figure 28B:
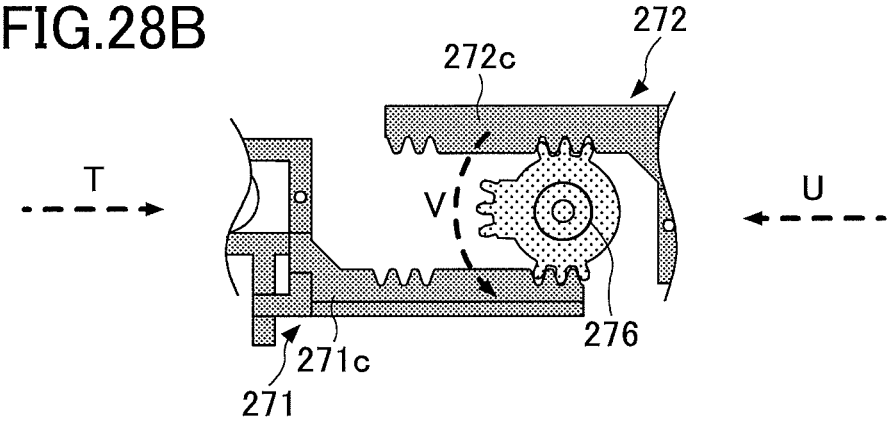
Figure 28C:
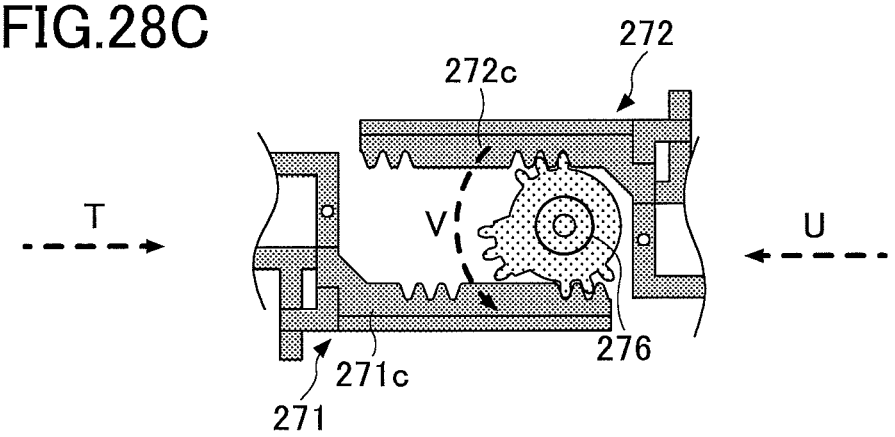

Referring also to FIGS. 28A, 28B, and 28C, the plate 271 includes a substantially L-shaped end portion 271*c*, and a gear 271*b* is provided in a part of the end portion 271*c* that is elongated in the widthwise direction of the lid 120. Likewise, the plate 272 includes a substantially L-shaped end portion 272*c*, and a gear 272*b* is provided in a part of the end portion 272*c*. The gear 276 is provided between the gears 271*b* and 272*b* to mesh with the gears 271*b* and 272*b*. Furthermore, the gear 276 meshes with a gear 273*a* provided on the rear surface of the button 273 as depicted in FIG. 23.

Figure 24A:
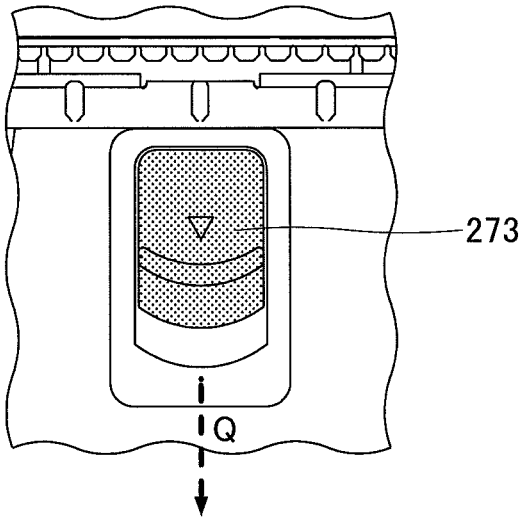
FIGS. 24A and 24B are diagrams for explaining the operation of closing the lid of the printer according to the second embodiment.
Figure 24B:
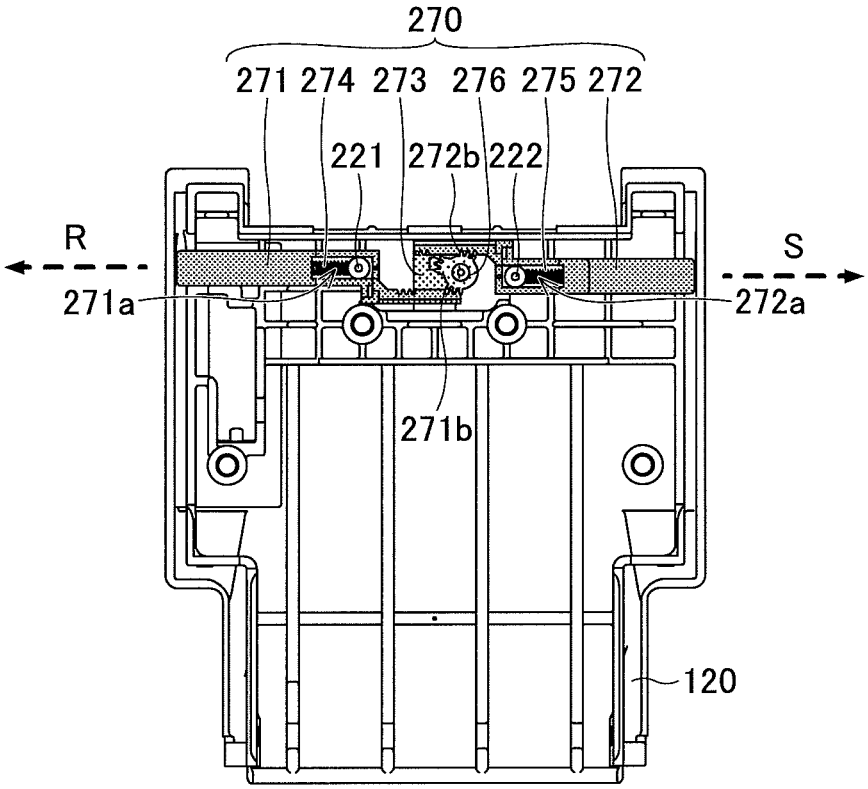

According to the printer of this embodiment as well, when the button 273 is not operated, the plates 271 and 272 are urged outward to prevent the lid 120 from being closed. FIG. 24A is a diagram illustrating the position of the button 273 in this state. FIG. 24B is a diagram depicting the inside of the lid 120 in this state. In FIG. 24B, the platen roller 140 and the cutter unit 150 are removed from the lid 120. Specifically, as depicted in FIGS. 24A and 24B, the restoring force of the spring 274 provided in the opening 271*a* is exerted on the plate 271 in the direction indicated by the dashed arrow R, and the restoring force of the spring 275 provided in the opening 272*a* is exerted on the plate 272 in the direction indicated by the dashed arrow S. Accordingly, the plates 271 and 272 are urged outward. Therefore, when an attempt to close the lid 120 is made, the plates 271 and 272 contact the frame 112 on each side of the holder 111 to prevent the lid 120 from being further moved in the closing direction (see, for example, FIG. 17A for the frame 112 and the holder 111).

Figure 25A:
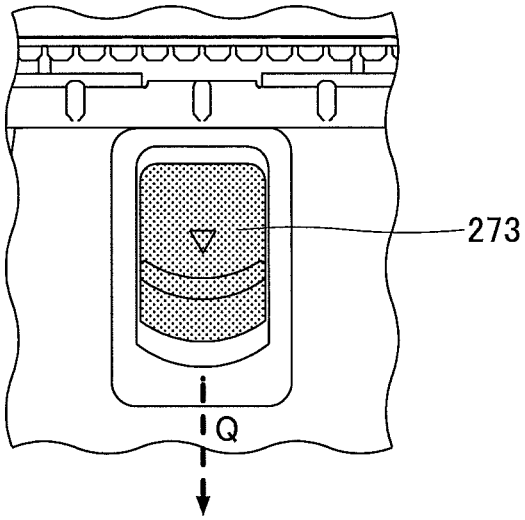
FIGS. 25A and 25B are diagrams for explaining the operation of closing the lid of the printer according to the second embodiment.
Figure 25B:
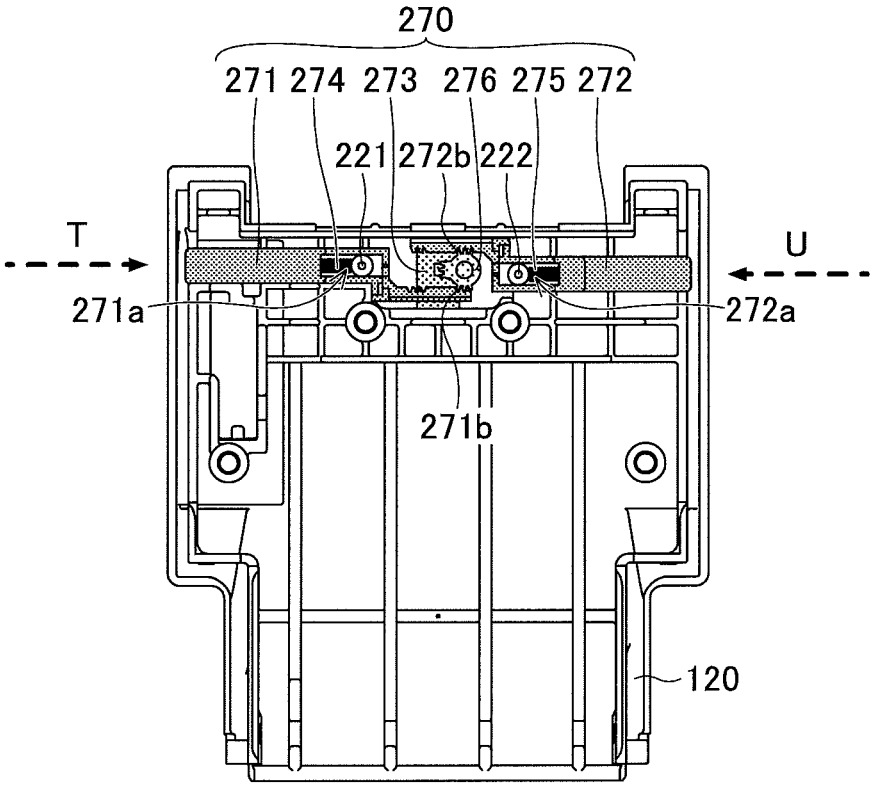
Figure 26A:
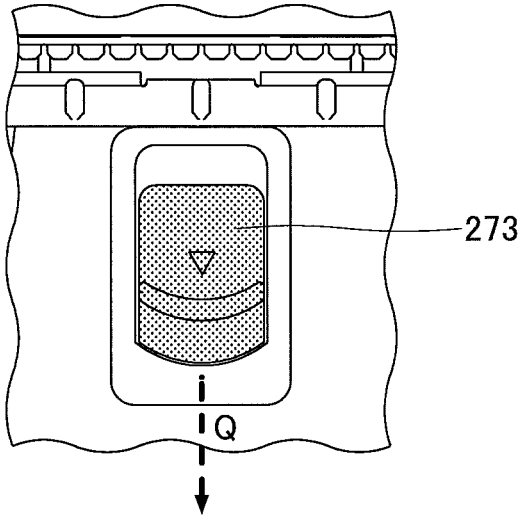
FIGS. 26A and 26B are diagrams for explaining the operation of closing the lid of the printer according to the second embodiment.
Figure 26B:
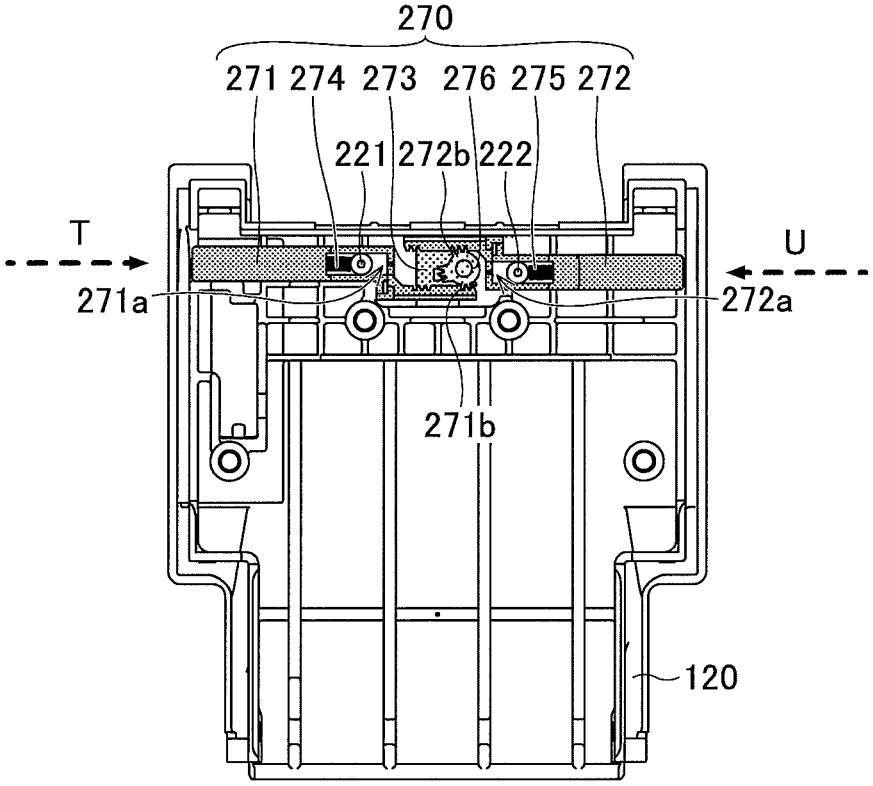

According to the printer of this embodiment, when closing the lid 120, the button 273 is slid downward from the position depicted in FIGS. 24A and 24B. As a result, the plates 271 and 272 slide to be in the state as depicted in FIGS. 25A and 25B and then in the state as depicted in FIGS. 26A and 26B. That is, the plate 271 slides in the direction indicated by the dashed arrow T, and the plate 272 slides in the direction indicated by the dashed arrow U, so that the plates 271 and 272 approach each other.

FIG. 25A illustrates the position of the button 273 and FIG. 25B depicts the inside of the lid 120 during the sliding of the button 273. FIG. 26A illustrates the position of the button 273 that is completely slid. FIG. 26B depicts the inside of the lid 120 where the button 273 is completely slide. In FIGS. 25B and 26B, the platen roller 140 and the cutter unit 150 are removed from the lid 120.

In conjunction with the sliding of the button 273 in the downward direction as depicted sequentially in FIGS. 25A and 25B and FIGS. 26A and 26B, the gear 273*a* provided on the button 273 also moves downward to rotate the gear 276.

Figure 27A:
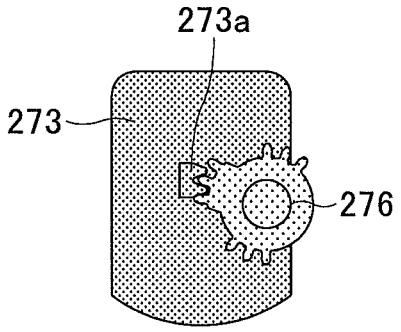
FIGS. 27A through 27C are diagrams for explaining the operation of closing the lid of the printer according to the second embodiment.
Figure 27B:
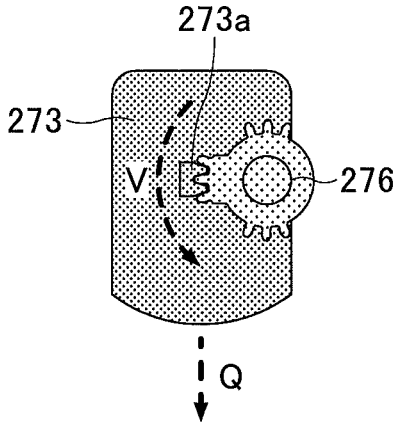
Figure 27C:
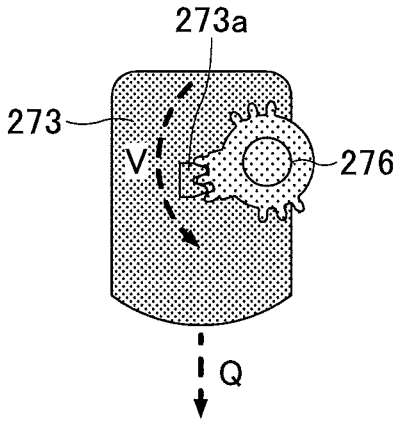

By moving the button 273 in the downward direction from the position depicted in FIG. 27A where the button 273 is not operated to the position depicted in FIG. 273, the gear 273*a* provided on the button 273 moves to rotate the gear 276 meshing with the gear 273*a* in the direction indicated by the dashed arrow V to the position depicted in FIG. 27C.

Furthermore, the gear 276 meshes with the gear 271*b* and the gear 272*b* as well. Therefore, by moving the button 273 in the downward direction from the position where the button 273 is not operated, the gear 276 rotates from the position depicted in FIG. 28A to the position depicted in FIG. 28C. As a result, the plate 271 whose gear 271*b* meshes with the gear 276 slides in the direction indicated by the dashed arrow T, and the plate 272 whose gear 272*b* meshes with the gear 276 slides in the direction indicated by the dashed arrow U, so that the plates 271 and 272 are in the state as depicted in FIG. 28C.

Thus, the plates 271 and 272 slide toward each other to retract to be positioned inside the frame 112. Therefore, the plates 271 and 272 enter the inside of the holder 111 to allow the closure of the lid 120.

In other respects than those described above, the second embodiment may be the same as the first embodiment.

Furthermore, the slide mechanism 270 of the second embodiment may alternatively be configured so that the button 273 is pressed toward the inside of the printer the same as the button 173 of the first embodiment. Likewise, the slide mechanism 170 of the first embodiment may alternatively be configured so that the button 173 moves downward along the outer surface of the lid 120 the same as the button 273 of the second embodiment. In these cases, the configurations of the slide mechanisms 170 and 270 are suitably modified.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A printer, comprising:

a body including a print head and a holder configured to accommodate a roll of recording sheet;

a lid attached to the body to be opened and closed relative to the body;

a platen roller attached to the lid;

a lock lever configured to support a bearing of the platen roller when the lid is closed;

a first plate and a second plate arranged on the lid in a widthwise direction of the printer; and a button provided on the lid and configured to be moved to slide the first and second plates toward each other, wherein when the button is moved to slide the first and second plates toward each other, an outer end of each of the first and second plates in the widthwise direction moves inward to be positioned inside an outer frame of the holder to allow closure of the lid relative to the body.

2. The printer as claimed in claim 1, wherein when the button is not moved, the outer end of each of the first and second plates contact the outer frame to prevent the closure of the lid.

3. The printer as claimed in claim 1, wherein the button includes a first slope and a second slope formed in a surface thereof that faces toward the holder when the lid is closed, the first plate includes a third slope and the second plate includes a fourth slope, and when the button is moved, the first slope moves on and along the third slope, and the second slope moves on and along the fourth slope, to slide the first and second plates toward each other.

4. The printer as claimed in claim 1, wherein the button includes a gear provided thereon that faces toward the holder when the lid is closed, the first plate includes a first gear and the second plate includes a second gear, a connecting gear is provided between the gear and the first and second gears to mesh with the gear and the first and second gears, and when the button is moved, the gear rotates the connecting gear to slide the first and second plates toward each other.

5. The printer as claimed in claim 1, further comprising:

a spring having a restoring force to move the first and second plates away from each other.

* * * * *